US008490976B2

(12) United States Patent
Salgado

(10) Patent No.: US 8,490,976 B2
(45) Date of Patent: Jul. 23, 2013

(54) DOUBLE-SIDED JIGSAW PUZZLE AND METHOD OF MAKING THE SAME

(76) Inventor: Cardin Flora Salgado, Richmond, VA (US)

( * ) Notice: Subject to any disclaimer, the term of this patent is extended or adjusted under 35 U.S.C. 154(b) by 274 days.

(21) Appl. No.: 12/687,881

(22) Filed: Jan. 15, 2010

(65) Prior Publication Data

US 2010/0194041 A1 Aug. 5, 2010

Related U.S. Application Data

(60) Provisional application No. 61/149,094, filed on Feb. 2, 2009.

(51) Int. Cl.
*A63F 3/00* (2006.01)

(52) U.S. Cl.
USPC ..... 273/278; 273/153 R

(58) Field of Classification Search
USPC ..... 273/157 A, 157 R, 153 R; 446/101, 446/97
See application file for complete search history.

(56) References Cited

U.S. PATENT DOCUMENTS

| | | | | | |
|---|---|---|---|---|---|
| 1,532,875 | A * | 4/1925 | Brown | 273/294 |
| 1,948,962 | A * | 2/1934 | Decker | 273/157 R |
| 2,011,058 | A * | 8/1935 | Krase | 273/157 R |
| 4,361,328 | A * | 11/1982 | Stein et al. | 273/156 |
| D320,050 | S * | 9/1991 | Mannino | D21/480 |
| 5,368,301 | A * | 11/1994 | Mitchell | 273/157 R |
| 5,957,454 | A * | 9/1999 | Libeskind | 273/157 R |
| 6,336,631 | B1 * | 1/2002 | Volkert | 273/157 R |
| 6,361,045 | B1 * | 3/2002 | Bernstein | 273/157 R |
| 6,425,581 | B1 * | 7/2002 | Barrett | 273/157 R |
| 6,634,928 | B2 * | 10/2003 | Erickson et al. | 451/40 |
| 7,383,978 | B2 * | 6/2008 | Michlin et al. | 229/92.8 |

FOREIGN PATENT DOCUMENTS

| | | | |
|---|---|---|---|
| EP | 432698 | A1 * | 6/1991 |
| GB | 2116050 | A * | 9/1983 |

* cited by examiner

*Primary Examiner* — Vishu K. Mendiratta

(57) ABSTRACT

A double-sided transparent plastic tessellated jigsaw puzzle and a method of making the same are disclosed. The puzzle is formed of a pair of clear acrylic sheets having a thickness of about 0.060 inches. Images are subsurface printed on one side of each sheet and the sheets are laminated together with a pressure-sensitive adhesive with the images in confronting relation. The laminated sheet is laser cut to form a puzzle that has a plurality of tessellations. The tessellations or sets of tessellations are formed as identically shaped pieces that can be located in the puzzle in several different ways.

7 Claims, 2 Drawing Sheets

Copyright 2009 Cardin Salgado

Copyright 2009 Cardin Salgado

Copyright 2009 Cardin Salgado

Copyright 2009 Cardin Salgado

Copyright 2009 Cardin Salgado

Copyright 2009 Cardin Salgado

DOUBLE-SIDED JIGSAW PUZZLE AND METHOD OF MAKING THE SAME

A portion of the disclosure of this patent document contains material which is subject to copyright protection. The copyright owner has no objection to the facsimile reproduction by any one of the patent document or the patent disclosure, as it appears in the Patent and Trademark Office patent file or records, but otherwise reserves all copyright rights whatsoever.

BACKGROUND OF THE INVENTION

1. Field of the Invention

The present invention relates to jigsaw puzzles and methods of making them and more particularly to double-sided jigsaw puzzles for use in entertainment and educational purposes.

2. Description of the Prior Art

Puzzles made of paper and other durable materials have entertained and educated since ancient times. The term "jigsaw puzzle" is derived from the name of a cutting machine, namely, a jigsaw, which is typically used to make intricate straight and curved cuts in non-metallic sheet materials. Modern jigsaw puzzles are cut by many different types of machines other than the conventional jigsaw, for example, by using a steel rule die to cut flat sheets of material, much in the same way cookies are cut out from a flat sheet of dough by a cookie cutter. It is generally agreed that the first jigsaw puzzle was produced around 1760 by John Spilsbury, a London engraver and mapmaker. Spilsbury mounted one of his maps on a sheet of hardwood and cut the borders of the countries using a fine-blade marquetry saw. These puzzles endured as the primary tools for teaching geography to British children until about 1820. In the United States, jigsaw puzzles increased in popularity during the depression years (1929-1940). Today, despite the wide spectrum of entertainment activities to choose from, jigsaw puzzles still have a strong and loyal following. Usually, a modern day puzzler seeks entertainment and is unaware that the act of solving a puzzle stimulates complex mental exercises that help strengthen spatial reasoning and memory.

A tessellation or tiling is created when a one or more shapes is repeated over and over again and covers a plane surface without any gaps or overlaps. Tessellations frequently appear in the art of M. C. Escher and are used for many different embodiments and applications, e.g., to provide coverings and decorations for planar surfaces, such as pedestrian walks, walls, counter tops, etc. and to provide patterns for games, puzzles, coloring books and the like.

- U.S. Pat. Nos. 5,230,508 and 4,824,112 to Tabler and Roy, respectively, both disclose the cutting of puzzle pieces using a laser apparatus.
- U.S. Pat. No. 5,217,226 to Christopher discloses a complex three-dimensional puzzle made of a transparent plastic with one or more images imbedded and suspended in the plastic.
- U.S. Pat. No. 6,309,716 and U.S. Pat. No. 5,945,181 both to Fisher disclose sets of tessellatable elements made of an acrylic plastic, in which a relatively low number of different elements may be combined together to provide attractive tessellating patterns.
- U.S. Design Pat. Nos. D 320,050 to Mannino and D353, 415 to Mitchell disclose double-sided jigsaw puzzles with tessellation patterns.

- U.S. Pat. No. 5,520,388 to Osborn discloses a single shape figurative tessellation or tiling that may be used in puzzles, games and other recreations.

The foregoing prior art and other prior art jigsaw puzzles with tessellated pieces have not provided the unique combination of material, print method, cutting method and identically shapes pieces of the double-sided jigsaw puzzle of the present invention. Nor does the prior art disclose the simple and effective method of making a double-sided jigsaw puzzle according to the present invention.

SUMMARY OF THE INVENTION

The present invention provides a two dimensional and double-sided puzzle that is made out of acrylic with a seemingly suspended image and tessellated puzzle piece pattern. The pieces can be interlocking or non-interlocking. The present invention also provides a method of making a double-sided jigsaw puzzle.

For the purpose of this patent tessellation is defined as: a piece of the puzzle that has both a type of shape and a quality of shape to form a repeating pattern. When the identical puzzle pieces, i.e., tessellations, are tiled, with no holes or overlaps in the same region of a plane, a repeating pattern occurs.

A set of tessellations is defined as: a repetitive grouping of tessellations, each grouping is identical to itself and has a total number of 2, 3, 4 or 5 differently shaped elements that are tiled together to form a set. This set is tiled with other tessellation sets in the same region of a plane to form a repeating pattern with no holes or overlaps.

According to its apparatus aspects, a first embodiment of the invention comprises a jigsaw puzzle with a double-sided image, with each side of the jigsaw puzzle having a different image. Each image of the jigsaw puzzle is seemingly floating or suspended within the puzzle by being sandwiched between two planar sheets of transparent acrylic, one on each outer side of the puzzle. The puzzle pieces of the invention, are formed preferably of a number identically shaped puzzle elements which, when tiled together to complete the puzzle images, create impressively noticeable tessellated patterns.

According to other embodiments of the invention, the images are printed as 3D or lenticular images; the puzzle pieces are formed by a number of differently shaped puzzle elements; the sheets of acrylic plastic are lenticular. The combination of a 3D lenticular image or a 3D image and a lenticular acrylic sheet can be used to enhance the floating or suspended appearance of the puzzle images on either side of the completed puzzle.

The puzzle of the invention is a jigsaw puzzle made of two planar or lenticular sheets of clear plastic, preferably an acrylic plastic material, or other clear plastic, such as a polycarbonate plastic sold under the tradename Lexan®. The same or different puzzle images are subsurface printed on one side of each clear plastic sheet, then bonded together using a pressure-sensitive adhesive with the image sides in aligned and confronting relation. The puzzle is then cut by laser cutting machine.

According to the method aspects of the present invention, a plurality of puzzle images are subsurface printed, by UV or screen printing or other printing process, such as sublimation, on one side of large sheets of clear acrylic plastic. After the images are printed on the acrylic sheets, a pressure-sensitive adhesive is used to bond the two printed acrylic sheets together with the image sides in aligned and confronting relation. The puzzle is then cut by laser cutting machine.

The proper acrylic material must be especially selected for thickness and its reaction to laser cutting. Although a ⅛-inch or thicker acrylic sheet may be selected, much time and energy is saved by choosing a 1/16-inch thick sheet of acrylic. The time and energy saved is crucial to the efficiency and expense of the mass production process and the floating image effect is still achieved with the thinner sheets of acrylic. After the puzzles are cut, the outermost peelable protective paper layers are removed.

With the foregoing and other objects, advantages and features of the invention that may become hereinafter apparent, the nature of the invention may be more clearly understood by reference to the following detailed description of the invention, the appended claims and the several drawings forming a part hereof.

DETAILED DESCRIPTION OF THE INVENTION

Figure 1:
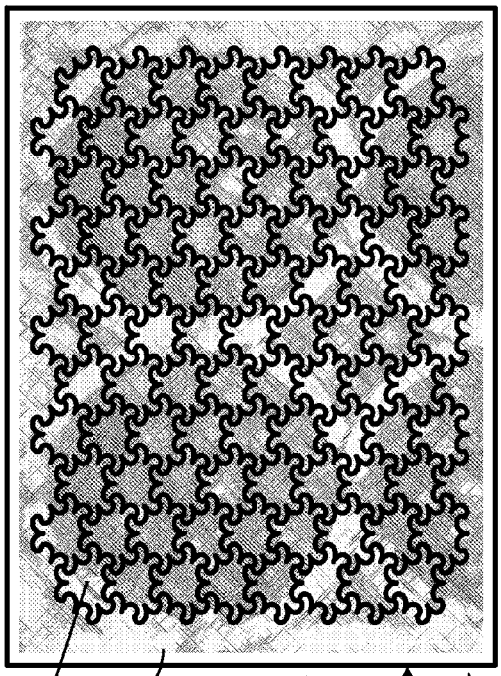
FIG. 1 is a plan view of one side of the assembled double-sided puzzle showing the tessellated puzzle pieces. Image not shown.
Figure 2:
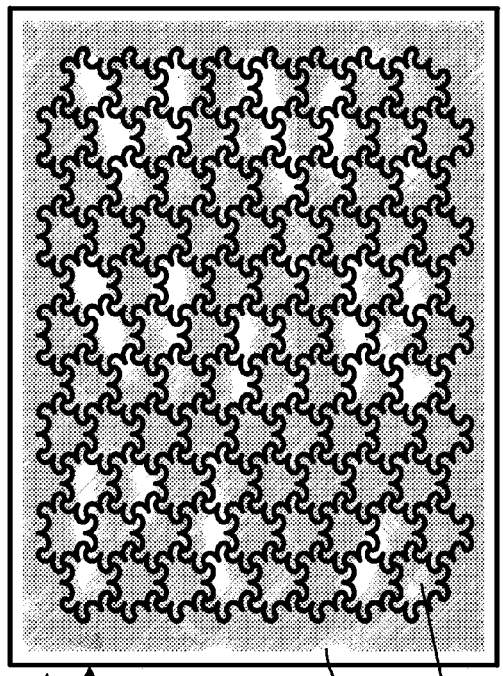
FIG. 2 is a plan view of the other side of the assembled double-sided puzzle showing the tessellated puzzle pieces. Image not shown.

FIG. 1 shows a front view of one embodiment of the assembled, double-sided puzzle 1 of the invention and FIG. 2 shows a rear view of the assembled puzzle 1. The puzzle 1 is formed of two bonded-together acrylic front and rear sheets 1A and 1B, respectively. The respective borders 2, 3 of the front and rear sheets 1A, 1B of the puzzle 1 can be formed as one continuous piece, but may also be formed as a plurality of puzzle pieces. Images not shown, which may be the same or different, are subsurface printed on the confronting sides of the sheets 1A, 1B and may extend into the borders 2 and 3 or not as desired. The bonded together sheets 1A, 1B are laser cut to form a plurality of identical interlocking tessellations 6 with no spaces between the tessellations 6.

As will be apparent to those skilled in the art from the puzzle illustrated in FIGS. 1 and 2, each tessellation has rotational symmetry. 6 may be inserted into the puzzle 1 at any location, in any one of three angular positions rotated 120° about its axis of symmetry and with its front or rear side facing upwardly. The rotational symmetry of the identical tessellations make solution of the puzzle dependent entirely on the image and, thus, much more challenging than a typical jigsaw puzzle having many differently shaped pieces and only a one-sided image. To make the puzzle 1 even more challenging, the symmetrical puzzle pieces 6 may each be trifurcated along any three vertical planes 120° apart into three smaller identical, but symmetrical pieces (shown by the dashed lines 12 in FIG. 3) so long as the planes do not cut the piece 6 into more than three pieces. This will triple the number of identical puzzle pieces from the number of pieces 6 shown in FIGS. 1 and 2. FIGS. 1 and 2 is an example a tessellation where the plurality of angular orientations is three.

Figure 3:
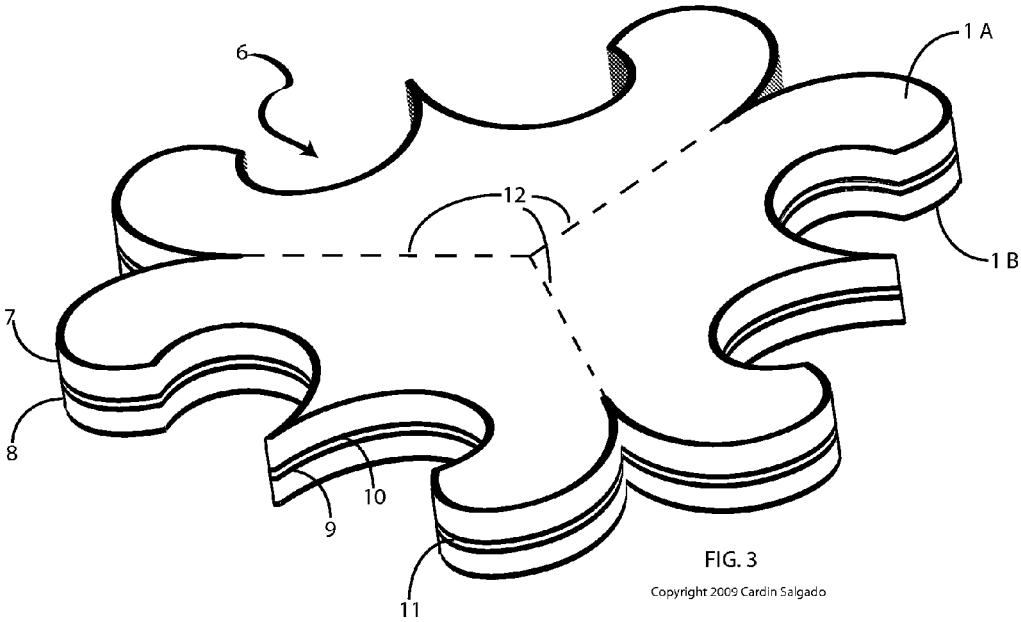
FIG. 3 is a perspective view of a single puzzle piece showing the layers of the puzzle piece.

FIG. 3 illustrates an enlarged, perspective view of one of the single puzzle pieces or tessellations 6 of the puzzle 1 of the invention. The puzzle piece edges 7, 8 are laser cut from the bonded-together acrylic sheets 1A, 1B. The sheets 1A, 1B are printed prior to laser cutting, by UV or screen printing or other suitable printing process, on their inwardly confronting sides with one or more layers of ink 9, 10, then bonded together, preferably, with a pressure sensitive film 11. The film 11 may be transparent if the images are transparent. The dashed lines 12 illustrate how a single symmetrical puzzle piece 6 may be trifurcated into three symmetrical puzzle pieces as described above.

Figure 4:
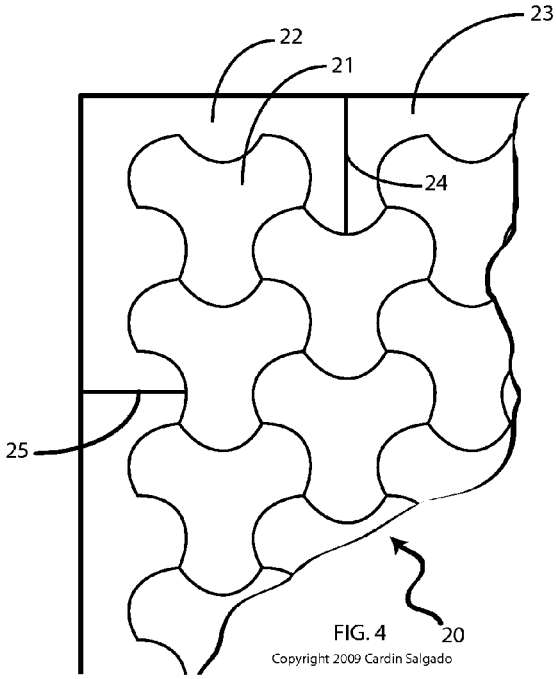
FIG. 4 is a fragmentary view of a second embodiment of the puzzle of the invention.
Figure 5:
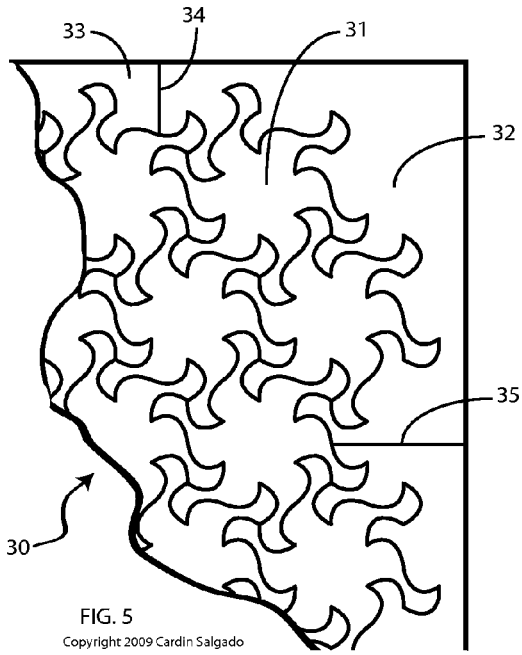
FIG. 5 is a fragmentary view of a third embodiment of the puzzle of the invention.
Figure 6:
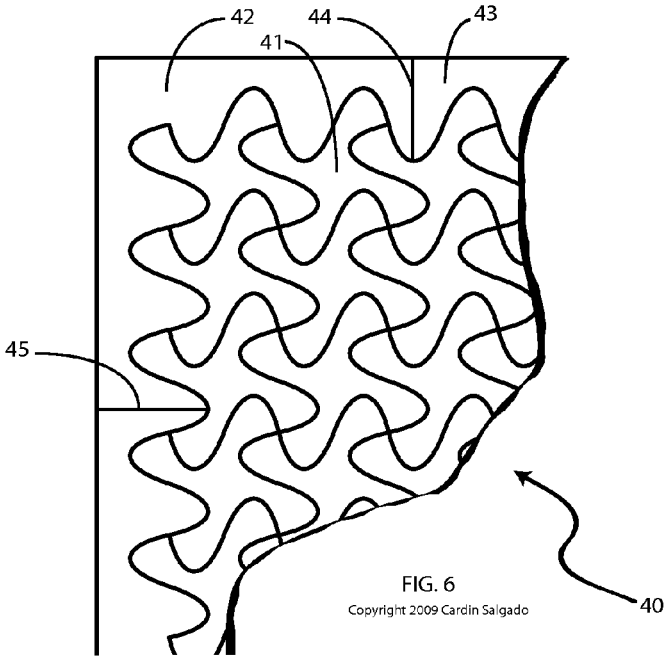
FIG. 6 is a fragmentary view of a fourth embodiment of the puzzle of the invention.

FIGS. 4-6 illustrate fragmentary views of other embodiments of the puzzle of the invention. In FIG. 4, for example, a puzzle 20 is formed with puzzle pieces or tessellations 21 of a simpler, identical and symmetrical shape than that of FIGS. 1 and 2, but having the same three angular possibilities for insertion into the puzzle 20 and the same possibilities for trifurcation into identical, but symmetrical pieces. The border of the puzzle 20 may also be laser cut along planes 24 and 25 to form additional pieces 22, 23 of the puzzle 20.

In the FIG. 5 embodiment, a puzzle 30 is formed with puzzle pieces or tessellations 31 of an identical and symmetrical, but more complex shape than those of FIGS. 1-4. Each tessellation 31 may be inserted into the puzzle in any location, in any one of six angular positions rotated 60° apart and with its front or rear side facing upwardly. There is also the possibility of furcating each tessellation 31 into six identical, but asymmetrical tessellations (not shown) along any six vertical planes 60° apart so long as the planes do not cut the tessellation 31 into more than six pieces. The border of the puzzle 30 may also be laser cut along planes 34 and 35 to form additional pieces 32, 33 of the puzzle 30. FIG. 5 in an example a tessellation where the plurality of angular orientations is six.

In the FIG. 6 embodiment, a puzzle 40 is formed with puzzle pieces or tessellations 41 of an identical and symmetrical shape. Each tessellation 41 may be inserted into the puzzle in any location, in any one of four angular positions rotated 90° apart and with its front or rear side facing upwardly. There is also the possibility of quadfurcating each tessellation 41 into four identical, but asymmetrical tessellations (not shown) along any four vertical planes 90° apart so long as the planes do not cut the tessellation 41 into more than four pieces. The border of the puzzle 40 may also be laser cut along planes 44 and 45 to form additional pieces 42, 43 of the puzzle 40. FIG. 5 in an example a tessellation where the plurality of angular orientations is four.

According to the method aspects of the present invention, a plurality of puzzles are formed starting, for example, with two 4 feet×8 feet (4×8) sheets of clear acrylic plastic of any suitable thickness, but preferably 0.060 inch thick 4×8 sheets of colorless Acrylite® AR (abrasion resistant) acrylic sheet manufactured by Evonik Industries and provided with a scratch-and-tear resistant peelable protective paper layer applied to both sides of the sheets. After the peelable paper layer on one side of both 4×8 sheets is removed, each sheet is placed in the bed of a large format UV inkjet printer whereby an image is subsurface printed on the paperless side using one or more ink layers with a plurality of identical images, e.g., 6 images which are 30-inch by 20-inch each. The image may be opaque or transparent and may also be applied by screen printing, although UV printing is preferred. Also, preferably, the images printed on the first sheet are different from the images printed on the second sheet, although the same images may be printed on both sheets.

After the images are printed on one side of each 4×8 acrylic sheet, a pressure-sensitive adhesive film, such as a FLEXcon® TT-202 2 mil thick pressure-sensitive film, is used to bond the two printed acrylic sheets together with the image sides in aligned and confronting relation. If the image is transparent, the pressure sensitive film should be transparent. The bonding may be accomplished by applying the pressure-sensitive adhesive adhesive to one or both image sides of the sheets and rolling the aligned sheets through a roll laminator, such as a 60-inch GBC roller laminator, to securely bond the aligned sheets together and remove any air bubbles that may have formed between the sheets. Alternatively, the individual puzzle images (e.g., the 30-inch by 20-inch images) on one printed 4×8 sheet may be first cut out and then bonded with the individual images cut out from the other printed 4×8 sheet. In this way, the roller laminator may be of a smaller size.

According to other embodiments of the invention the images are printed as 3D or lenticular images, the puzzle pieces are formed of a number of differently-shaped puzzle elements or the sheets of acrylic plastic are lenticular. The combination of a 3D lenticular image or a 3D image and a lenticular acrylic sheet giving a moving 3D effect in addition to enhancing the floating or suspended appearance of the puzzle images on either side of the completed puzzle.

Now, the laminated 4×8 sheets (or the 30-inch by 20-inch sheets) still with the manufacturer's peelable protective paper layer on both outermost sides of the sheets are prepared for laser cutting. If the paper layer smokes excessively during lasing, either because of the type or quality of the paper or because of the type or power of the laser cutting machine, the peelable paper layer may be removed and replaced with an R Tape Conform Series® medium or low tack transfer tape manufactured by R Tape Corporation, 6 Ingersoll Road, South Plainfield, N.J. 07080. The laminated sheets are then placed in the cutting bed of a programmable laser cutting machine, which is preferably a 2000 watt CO2 laser with a bed large enough to accommodate a 4×8 acrylic plastic sheet. One suitable laser is a Mazak 2000 watt CO2. The lasing machine is programmed to cut the tessellations of each puzzle on the 4×8 sheet and to cut the periphery or outer edge of each of the plurality of puzzles on the 4×8 sheet.

After the laser cutting is completed, the cut sheets are removed from the laser cutting machine and placed between a pair of large planar surfaces. The uppermost planar surface is lifted from the sheet and the paper layer is treated with an aqueous solution that reacts with the paper adhesive and renders the paper more easily removable from the sheet with a sponge or squeegee. The uppermost planar surface is then placed back onto the now paper-free side of the laminated sheet, the sheet is turned over, the now-uppermost planar surface is raised from the laminated sheet and the paper layer is removed from that side of the laminated sheet as described above. The individual puzzles may now be bagged and/or packaged.

Although certain presently preferred embodiments of the invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What I claim as my invention is:

1. A jigsaw puzzle comprising: A plurality of identical tessellation pieces or sets of tessellation pieces and a plurality of border pieces; the border pieces and the plurality of tessellation pieces configured to complete the jigsaw puzzle, the jigsaw puzzle when completed showing a first floating image on a first side and a second floating image on a second side of the jigsaw puzzle; the top half of each tessellation piece having a top transparent plastic sheet of thickness with a portion of the first image subsurface printed directly on one side of the substrate; the bottom half of each tessellation piece having a bottom transparent plastic sheet of thickness with a portion of the second image subsurface printed directly on one side of the substrate; each tessellation piece having the top and the bottom transparent plastic sheets permanently laminated to each other with an adhesive there between and with portions of the prints in inwardly confronting relation; each tessellation piece being identical in peripheral shape or being of a tessellation set with no space between.

2. The jigsaw puzzle in claim 1, wherein the plurality of angular orientations for each tessellation, not including the border tessellations, is three or four.

3. The jigsaw puzzle in claim 1, wherein the images are subsurface printed on each transparent plastic sheet using one or more layers of opaque ink and the plastic sheets are laminated together with an opaque or transparent pressure sensitive adhesive.

4. The jigsaw puzzle of claim 1, wherein the border is a plurality of tessellation pieces.

5. The jigsaw puzzle of claim 1, wherein the first and second images are different.

6. A method of making a two-sided puzzle comprising the steps of: providing a pair of planar transparent acrylic sheets, each having a first and second sides, a thickness and a protective layer on both sides of said sheets; removing the protective layer from side one of each sheet; Subsurface printing an image on said side one of each sheet; superimposing the said sheets with said side ones in confronting relation and inserting a pressure sensitive adhesive between said sheets, thus forming laminate, whereby a two-sided image appears to be floating or suspended within the said laminate sheet, if the image is transparent then the adhesive needs to be transparent; laser cutting the said laminate sheet to form puzzle of repeating identical tessellations or repeating sets of tessellations; and removing the protective layer from the outer sides of said puzzle, the protective layer is treated with an aqueous solution that dissolves the protective layer's adhesive, making it more easily removable from the puzzle with a sponge or squeegee.

7. A method of making a two-sided puzzle comprising the steps of: providing a pair of planar transparent acrylic sheets, each having a first and second sides, a thickness of about 0.062 or 0.125 inches and a protective layer on both sides of said sheets; removing the protective layer from side one of each sheet; Subsurface printing an image using UV inks on said side one of each sheet; superimposing the said sheets with said side ones in confronting relation and inserting a pressure sensitive adhesive between said sheets, if the image is transparent then the adhesive is transparent; rolling said sheets through a roller to bond said sheets together and roll out air bubbles from between said sheets, thus forming a laminate, whereby a two-sided image appears to be floating or suspended within the said laminate; laser cutting the said laminate sheet to form puzzle of repeating identical tessellations or repeating sets of tessellations; and removing the protective layer from the outer sides of said puzzle, the protective layer is treated with an aqueous solution that dissolves the protective layer's adhesive, making it more easily removable from the puzzle with a sponge or squeegee.

* * * * *